US008056526B2

(12) United States Patent
Chung

(10) Patent No.: US 8,056,526 B2
(45) Date of Patent: Nov. 15, 2011

(54) MAGNESIUM OIL PAN

(75) Inventor: Yen Jun Chung, Seoul (KR)

(73) Assignee: Hyundai Motor Company, Seoul (KR)

( * ) Notice: Subject to any disclaimer, the term of this patent is extended or adjusted under 35 U.S.C. 154(b) by 484 days.

(21) Appl. No.: 12/332,754

(22) Filed: Dec. 11, 2008

(65) Prior Publication Data

US 2010/0043741 A1 Feb. 25, 2010

(30) Foreign Application Priority Data

Aug. 21, 2008 (KR) ..... 10-2008-0081936

(51) Int. Cl.
*F02B 77/00* (2006.01)

(52) U.S. Cl. ..... 123/195 C; 123/196 R

(58) Field of Classification Search ..... 123/195 C, 123/196 R; 184/6.5
See application file for complete search history.

(56) References Cited

FOREIGN PATENT DOCUMENTS

| | | | |
|---|---|---|---|
| JP | 63-224852 | | 9/1988 |
| JP | 01-271026 | | 10/1989 |
| JP | 05-179921 | A | 7/1993 |
| JP | 08-144848 | A | 6/1996 |
| JP | 09-014049 | | 1/1997 |
| JP | 2001-132537 | A | 5/2001 |
| JP | 2002-349226 | A | 12/2002 |

*Primary Examiner* — Noah Kamen
(74) *Attorney, Agent, or Firm* — Morgan, Lewis & Bockius LLP

(57) ABSTRACT

A magnesium oil pan prevents noise and vibration by attaching reinforcement members to portions that are weak in strength and are vulnerable to vibration. The magnesium oil pan includes a flange formed on an upper surface of the oil pan so as to be coupled with the cylinder block, a lower oil pan coupler formed on a lower surface of the oil pan so as to protrude downwards, and a bracket formed on a lateral surface of the oil pan so as to be coupled with a chain cover of the engine. The lower oil pan coupler includes a main reinforcement rib on an inner side of the oil pan which continuously runs between opposite inner walls of the lower oil pan coupler and protrudes downwards. Thus, the magnesium oil pan is made lightweight, improves noise-proof performance, and is hardly damaged by external impacts.

20 Claims, 2 Drawing Sheets

MAGNESIUM OIL PAN

CROSS-REFERENCE TO RELATED APPLICATION

The present application claims priority of Korean Patent Application No. 10-2008-0081936, filed on Aug. 21, 2008, the entire contents of which application is incorporated herein for all purposes by this reference.

BACKGROUND OF THE INVENTION

1. Field of the Invention

The present invention relates to a magnesium oil pan and, more particularly, to a magnesium oil pan in which reinforcement members are attached to portions that are weak in strength and are vulnerable to vibration in order to maximize reduction in weight and improve noise-proof performance, thereby preventing noise and vibration.

2. Description of Related Art

An oil pan is a reservoir that encloses a crank case and stores engine oil. The oil pan is detachably mounted on the lower portion of an engine, and is typically made of metal such as aluminum. The oil stored in the oil pan circulates around components of the engine by means of an oil pump, and then returns to the oil pan. At this time, the engine oil absorbs heat from the individual components, thereby cooling the individual components. Further, the engine oil forms an oil film on these components, thereby increasing lubrication between the components and preventing oxidation of the components.

Meanwhile, attempts have recently been made to reduce weight of each part mounted on a motor vehicle in order to fulfill demands for weight reduction and performance enhancement of the motor vehicle. This tendency is applied to the oil pan. To this end, a material of which the oil pan is made is substituted by magnesium, which is a lightweight material, for aluminum, which is an existing material.

Magnesium has an advantage of being lighter than aluminum but a disadvantage of being 2/3 times the strength of aluminum since the elastic modulus of magnesium is 45 GPa while that of aluminum is 75 GPa. As such, if the oil pan is made of magnesium instead of aluminum without a change in design, the oil pan mounted on the lower portion of the engine is subjected to vibration due to direct transmission of vibration from the engine, and thus generating noise. Furthermore, the oil pan is mounted on the lower portion of the engine, and thus is frequently exposed to external impacts. Accordingly, in the case in which the oil pan has weak rigidity, the oil pan is damaged by such external impacts.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide for a magnesium oil pan, weak portions of which are reinforced by varying a thickness and a shape thereof in order to compensate for insufficient rigidity of magnesium as compared with aluminum, thereby maximizing reduction in weight, improving noise-proof performance, and withstanding external impacts.

In an aspect of the present invention, the magnesium oil pan mounted on a lower portion of a cylinder block of an engine which may include a flange formed on an lateral surface in a middle portion of the oil pan so as to be coupled with the cylinder block, a lower oil pan coupler formed in a lower portion of the oil pan so as to protrude downwards from a bottom surface of the oil pan, and/or a bracket formed in an upper portion of the oil pan so as to be coupled with a chain cover of the engine, wherein the lower oil pan coupler includes a main reinforcement rib on the bottom surface of the oil pan, the main reinforcement rib continuously running between both opposite inner walls of the lower oil pan coupler and protruding downwards from the bottom surface of the oil pan. A flat portion may be formed on the flange between the lower oil pan coupler and the bracket. The lower oil pan coupler may have first reinforcement member on an outer lower wall of the lower oil pan coupler, the first reinforcement member extending to a lower surface of the oil pan. The lower oil pan coupler may have an auxiliary reinforcement rib continuously running from an inner wall of the lower oil pan coupler toward the other opposite inner wall and protruding downwards from the bottom surface of the oil pan, wherein the auxiliary reinforcement rib has second reinforcement member on one lateral surface of the auxiliary reinforcement rib, the second reinforcement member extending to the bottom surface of the oil pan. The main reinforcement rib may have third reinforcement member on one lateral surface of the main reinforcement rib, the third reinforcement member extending to the bottom surface of the oil pan. The bracket may have reinforcement post extending from the bracket to the bottom surface of the oil pan in the oil pan in a longitudinal direction thereof. The main reinforcement rib may have a lowest height of 2 mm to 5 mm.

In another aspect of the present invention, a magnesium oil pan, which is mounted on a lower portion of a cylinder block of an engine may include: a flange formed on a lateral surface in a middle portion of the oil pan so as to be coupled with the cylinder block, a lower oil pan coupler formed in a lower portion of the oil pan so as to protrude downward from a bottom surface of the oil pan, and/or a bracket formed in an upper portion of the oil pan so as to be coupled with a chain cover of the engine, wherein the lower oil pan coupler has first reinforcement member on an outer lower wall of the oil pan, the first reinforcement member extending to a lower surface of the oil pan. The first reinforcement member may have a width of 1.5 mm to 3 mm. The oil pan may include four or more first reinforcement members.

In further aspect of the present invention, a magnesium oil pan, which is mounted on a lower portion of a cylinder block of an engine, may include: a flange formed on a lateral surface in a middle portion of the oil pan so as to be coupled with the cylinder block, a lower oil pan coupler formed in a lower portion of the oil pan so as to protrude downwards from a bottom surface of the oil pan, and/or a bracket formed in an upper portion of the oil pan so as to be coupled with a chain cover of the engine, wherein the lower oil pan coupler has an auxiliary reinforcement rib on an bottom surface of the oil pan which protrudes downwards, and wherein the auxiliary reinforcement rib has second reinforcement member on one lateral surface of the auxiliary reinforcement rib, the second reinforcement member extending to the bottom surface of the oil pan. The second reinforcement member may have a width of 1.5 mm to 3 mm. The auxiliary reinforcement rib may continuously run from an inner wall of the lower oil pan coupler toward the other opposite inner wall and protrudes downwards from the bottom surface of the oil pan.

In still further aspect of the present invention, a magnesium oil pan, which is mounted on a lower portion of a cylinder block of an engine, may include: a flange formed on a lateral surface in a middle portion of the oil pan so as to be coupled with the cylinder block, a lower oil pan coupler formed in a lower portion of the oil pan so as to protrude downwards from a bottom surface of the oil pan, and/or a bracket formed in an upper portion of the oil pan so as to be coupled with a chain cover of the engine, wherein the bracket has reinforcement post extending to the bottom surface of the oil pan. The reinforcement post may extend to the bottom surface in the oil pan in a longitudinal direction thereof. The oil pan may include four or more reinforcement posts.

In another aspect of the present invention, a magnesium oil pan, which is mounted on a lower portion of a cylinder block of an engine, may include: a flange formed on a lateral surface in a middle portion of the oil pan so as to be coupled with the cylinder block, a lower oil pan coupler formed in a lower portion of the oil pan so as to protrude downwards from a bottom surface of the oil pan, a bracket formed in a upper portion of the oil pan so as to be coupled with a chain cover of the engine, and/or a flat portion formed on the flange between the lower oil pan coupler and the bracket. The flat portion may have a thickness of 3.5 mm or more.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Figure 1:
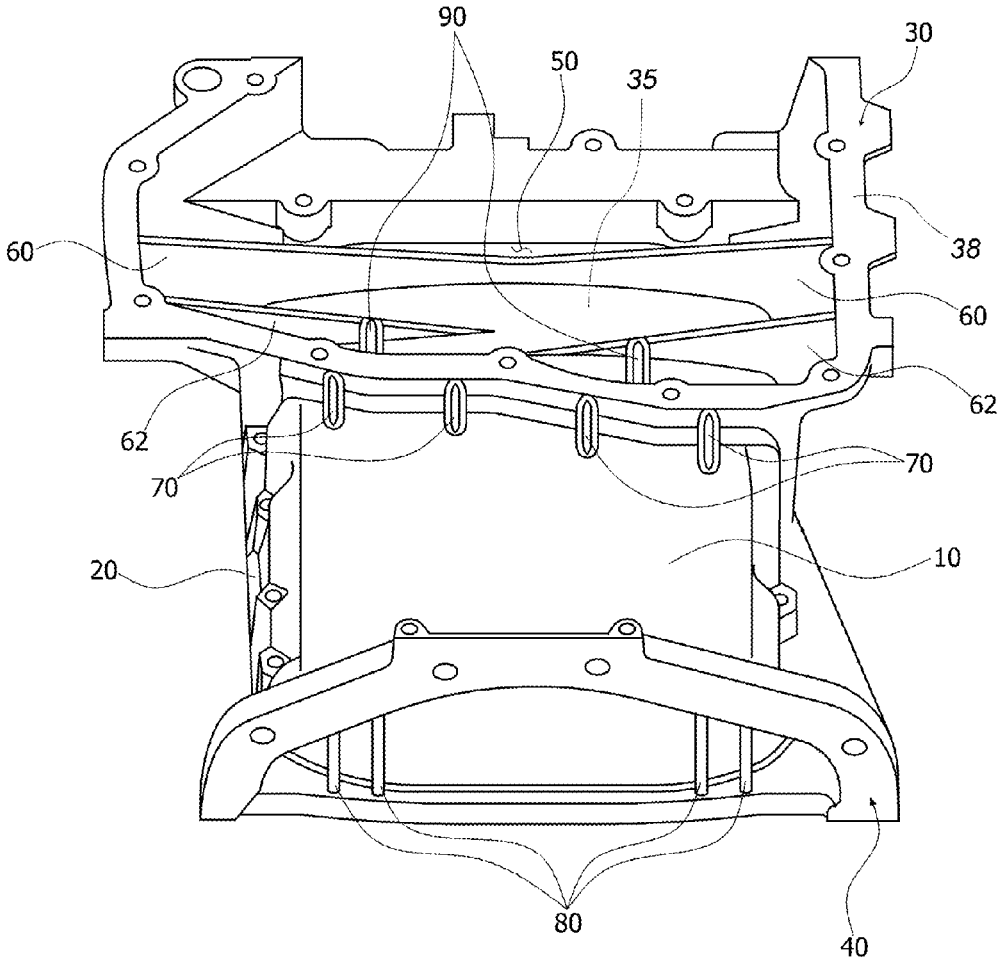
FIG. 1 schematically illustrates an exemplary magnesium oil pan according to the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In various embodiments of the present invention, a magnesium oil pan includes a flange 20 formed in the middle portion thereof so as to be coupled with the cylinder block of an engine, a lower oil pan coupler 30 formed in the lower portion thereof so as to protrude downwards, and a bracket 40 formed in the upper portion thereof so as to be coupled with a chain cover of the engine, and thereby is mounted on a lower portion of the cylinder block of the engine.

The lower oil pan coupler 30 formed in the lower portion thereof has a main reinforcement rib 60 on an bottom surface 35 thereof which continuously runs between opposite inner walls of the lower oil pan coupler 30 in a traverse direction. The main reinforcement rib 60 has the lowest height of 2 mm to 5 mm as explained later.

Further, in various embodiments of the present invention, the lower oil pan coupler 30 has first reinforcement members 70 on an outer wall thereof which extend to the lower surface 38 of the oil pan in a longitudinal direction of the oil pan. Each of the first reinforcement members 70 has a width of 1.5 mm to 3 mm, and the number of first reinforcement members 70 is four or more.

In a various embodiments of the present invention, the lower oil pan coupler 30 is provided with an auxiliary reinforcement rib 62 on an inner side thereof which protrudes downwards.

The auxiliary reinforcement rib 62 ranges about half of length between opposite inner walls of the lower oil pan coupler 30 in a traverse direction, one end of which continuously decreases from a inner wall of the lower oil pan coupler 30 with a predetermined angle.

The auxiliary reinforcement rib 62 has second reinforcement members 90 on one surface thereof which extend downwards. Each of the second reinforcement members 90 has a width of 1.5 mm to 3 mm sufficient enough to support the second reinforcement members 90 in the longitudinal direction of the oil pan.

In various embodiments of the present invention, the oil pan may include reinforcement posts 80 formed between the bracket 40 and the lower oil coupler 30. The number of reinforcement posts 80 may be four or more.

In various embodiments of the present invention, the oil pan may include a flat portion 10 between the lower oil pan coupler 30 and the bracket 40. The flat portion 10 has a thickness of 3.5 mm or more.

Now, the magnesium oil pan according to various embodiments of the present invention will be described in detail with reference to the accompanying drawings.

Throughout the drawings, it is noted that the same reference numerals or letters will be used to designate like or equivalent elements having the same function. In the following description of the present invention, a detailed description of known functions and components incorporated herein will be omitted when it may make the subject matter of the present invention rather unclear.

FIG. 1 schematically illustrates a magnesium oil pan according to various embodiments of the present invention. FIG. 1 shows that the direction in which the oil pan is really mounted on a motor vehicle is reversed in order to clearly show a lower portion of the oil pan. Thus, when viewed from FIG. 1 the lower portion of the oil pan is really an upper side whereas the upper portion of the oil pan is really a lower side in the drawing.

According to various embodiments of the present invention, as illustrated in FIG. 1, the magnesium oil pan includes the flange 20 formed on a lateral surface in the middle portion thereof along longitudinal direction of the oil pan, the lower oil pan coupler 30 formed in a lower portion thereof, the bracket 40 formed in upper portion thereof, and the flat portion 10 formed in the middle portion, i.e., between the lower oil pan coupler 30 and the bracket 40.

The flange 20 has a plurality of first fixing holes 22 into which bolts are inserted so as to allow the oil pan to be mounted on a lower portion of the cylinder block. Similarly, the cylinder block has a plurality of second fixing holes corresponding to the first fixing holes. The bolts pass through the first and second fixing holes, so that the oil pan is coupled to the cylinder block.

The lower oil pan coupler 30 formed in the lower portion of the oil pan is for coupling a lower oil pan for storing a large quantity of oil, protrudes downwards from the bottom surface 35 of the oil pan, and has a plurality of fixing holes 34 formed on the lower surface 38.

The bracket 40 formed at upper portion of the oil pan is coupled to a chain cover formed on the lateral surface of the engine. When the bracket 40 is coupled to the chain cover, the oil pan can be mounted on the engine in a more stable fashion.

In various embodiments of the present invention, as illustrated in FIG. 1, the magnesium oil pan is shaped of a deep tray, the top of which faces the cylinder block and is open. The lower oil pan coupler 30 has a tunnel 50 formed on the bottom surface 35 thereof, so that the oil stored in the lower oil pan coupler 30 can flow into the cylinder block through the tunnel 50.

The flat portion 10, which is formed between the lower oil pan coupler 30 and the bracket 40 and occupies most of the area of the oil pan, serves as a body of the oil pan.

The flat portion 10 is shaped of a thin sheet, and is not supported or reinforced by another portion. Thus, the flat portion 10 makes it easy to cause vibration. Particularly, the flat portion 10 is thin and wide, and thus is easier to cause noise as compared to other components when the vibration occurs.

Thus, the flat portion 10 preferably has a thickness of 3.5 mm or more in order to prevent the vibration.

In order to prevent the vibration, it is advantageous to the flat portion 10 to have the increased thickness of the flat portion 10. However, since the weight of the oil pan is increased in proportion to the thickness of the flat portion 10, it is advantageous to the weight reduction of the oil pan to determine the thickness of the flat portion 10 to the least level which anti-vibration performance can reach.

The main reinforcement rib 60 protrudes downwards on the bottom surface 35 of the lower oil pan coupler 30. At this time, the main reinforcement rib 60 continuously runs between the opposite inner walls of the lower oil pan coupler 30 in a traverse direction thereof, so that the opposite inner walls of the lower oil pan coupler 30 are connected by the main reinforcement rib 60.

The main reinforcement rib 60 is designed so that its height is gradually lowered from the inner walls of the lower oil pan coupler 30 in both sides to the middle thereof, which is advantageous in preventing the vibration and noise.

This height can be determined through various analysis methods on the basis of a shape of the oil pan. The lowest height preferably ranges from 2 mm to 5 mm. In detail, when the lowest height is less than 2 mm, the effect of preventing the vibration and noise is degraded. In contrast, when the lowest height is more than 5 mm, there is a possibility of interfering with the lower oil pan.

Further, the auxiliary reinforcement rib 62 protrudes downwards from the bottom surface 35 of the lower oil pan coupler 30, and is spaced apart from the main reinforcement rib 60 and runs in parallel each other.

The auxiliary reinforcement rib 62 is for assisting the main reinforcement rib 60 to prevent the vibration and noise. The auxiliary reinforcement rib 62 may be installed in plural number depending on the shape of the oil pan.

Furthermore, the second reinforcement members 90 having a width of 1.5 mm to 3 mm are attached to the lateral side of the auxiliary reinforcement rib 62, and extend to the bottom surface 35 of the oil pan.

When the widths of the first and second reinforcement members 70 and 90 are less than 1.5 mm, it is advantageous in making the oil pan lightweight, but the anti-vibration performance is insufficient.

In contrast, when the widths of the first and second reinforcement members 70 and 90 are more than 3 mm, it is advantageous to the anti-vibration performance, but the oil pan becomes heavy.

In order to simultaneously meet the anti-vibration performance and the weight reduction, the widths of the first and second reinforcement members 70 and 90 preferably ranges from 1.5 mm to 3 mm.

Meanwhile, the lower oil pan coupler 30 protrudes downwards from the bottom surface 35 of the oil pan and the bottom surface 35 is bent convexly.

Further, since the lower oil pan is coupled to the lower oil pan coupler 30, the lower oil pan coupler 30 is relatively vulnerable to the vibration as compared to other components. Thus, the first reinforcement members 70 having a width of 1.5 mm to 3 mm are attached to the outer lower wall of the lower oil pan coupler 30 and extend to the lower surface 38 of the oil pan. In this case, the number of first reinforcement members 70 is preferably four or more in order to prevent the vibration.

In various embodiments of the present invention, a third reinforcement member may be attached to the main reinforcement rib 60. The third reinforcement member may extend from the bottom surface 35 of the oil pan so that further support the main reinforcement rib 60.

Further, the bracket 40 coupled with the chain cover is vulnerable to the vibration. The bracket 40 includes reinforcement posts 80 disposed in the oil pan and extending to the bottom surface 35 of the oil pan in the longitudinal direction thereof. The number of reinforcement posts 80 is preferably four or more. These reinforcement posts 80 absorb the vibration of a chain which is transmitted through the chain cover, so that the vibration of the oil pan is prevented.

As described above, the portion where the components are coupled with each other, the portion where the boundary between the components is bent, and the flat portion having a wide area are vulnerable to the vibration and noise. Thus, in various embodiments of the present invention, the main reinforcement rib 60, the auxiliary reinforcement rib 62, the first reinforcement members 70, and the second reinforcement members 90 are attached to these portions, thereby increasing the thickness of the flat portion 10 and the resulting fastening strength, and inhibiting the vibration of the flat portion 10.

Figure 2:
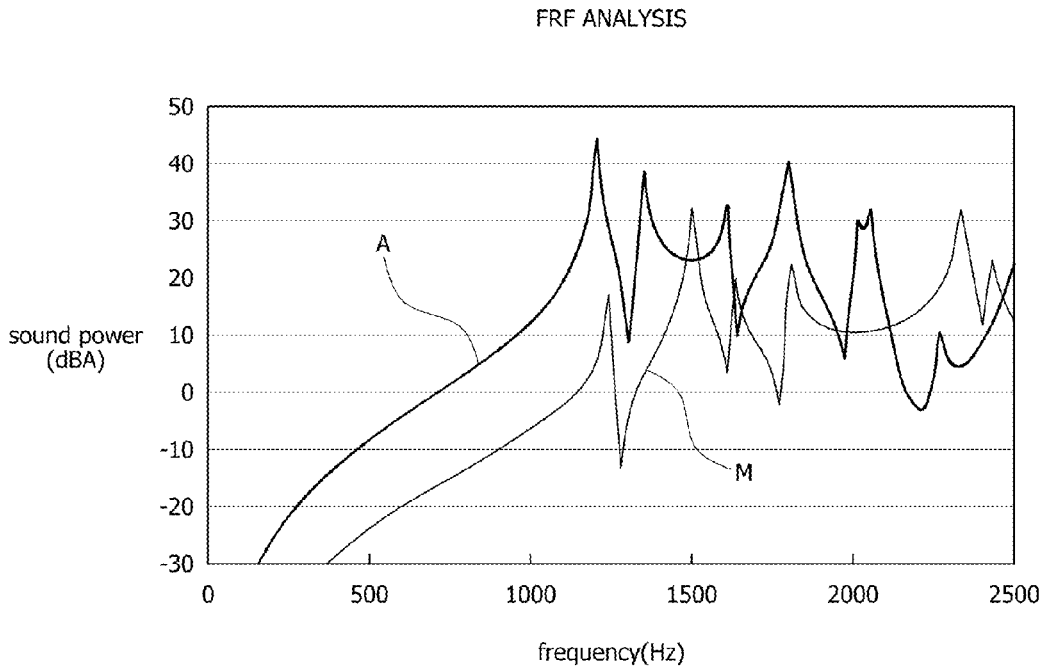
FIG. 2 is a graph showing the results of a frequency response function (FRF) analysis performed on an exemplary magnesium oil pan of the present invention and on a conventional aluminum oil pan.

These effects are shown in FIG. 2. FIG. 2 is a graph showing the results of frequency response function (FRF) analysis performed on an inventive magnesium oil pan and a conventional aluminum oil pan. In FIG. 2, Curve A shows the FRF analysis results for the conventional aluminum oil pan, while Curve M shows the FRF analysis results for the inventive magnesium oil pan.

Noise and vibration characteristics of the motor vehicle are determined by frequency of 1000 Hz or less. As illustrated in FIG. 2, in the case of the magnesium oil pan (Curve M) according to various embodiments of the present invention, it could be found that noise and vibration performance was improved by 60% at frequency of 1000 Hz or less as compared to the conventional aluminum oil pan (Curve A).

Furthermore, the weight of the conventional aluminum oil pan was 3.48 kg, while the weight of the inventive magnesium oil pan was 2.49 kg, and thus could obtain the weight reduction of 28%.

According to exemplary embodiments of the present invention as set forth above, the weak rigidity portions of the magnesium oil pan are reinforced by increasing their thicknesses and attaching reinforcement ribs, so that the magnesium oil pan is made lightweight, improves noise-proof performance, and is hardly damaged by external impacts.

For convenience in explanation and accurate definition in the appended claims, the terms "upper" or "lower", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A magnesium oil pan, which is mounted on a lower portion of a cylinder block of an engine, comprising:

a flange formed on a lateral surface in a middle portion of the oil pan so as to be coupled with the cylinder block;

a lower oil pan coupler formed in a lower portion of the oil pan so as to protrude downwards from a bottom surface of the oil pan; and a bracket formed in an upper portion of the oil pan so as to be coupled with a chain cover of the engine, wherein the lower oil pan coupler includes a main reinforcement rib on the bottom surface of the oil pan, the main reinforcement rib continuously running between both opposite inner walls of the lower oil pan coupler and protruding downwards from the bottom surface of the oil pan.

2. The magnesium oil pan according to claim 1, wherein a flat portion is formed on the flange between the lower oil pan coupler and the bracket.

3. The magnesium oil pan according to claim 1, wherein the lower oil pan coupler has first reinforcement member on an outer lower wall of the lower oil pan coupler, the first reinforcement member extending to a lower surface of the oil pan.

4. The magnesium oil pan according to claim 1, wherein the lower oil pan coupler has an auxiliary reinforcement rib continuously running from an inner wall of the lower oil pan coupler toward the other opposite inner wall and protruding downwards from the bottom surface of the oil pan.

5. The magnesium oil pan according to claim 4, wherein the auxiliary reinforcement rib has second reinforcement member on one lateral surface of the auxiliary reinforcement rib, the second reinforcement member extending to the bottom surface of the oil pan.

6. The magnesium oil pan according to claim 1, wherein the main reinforcement rib has third reinforcement member on one lateral surface of the main reinforcement rib, the third reinforcement member extending to the bottom surface of the oil pan.

7. The magnesium oil pan according to claim 1, wherein the bracket has reinforcement post extending from the bracket to the bottom surface of the oil pan in the oil pan in a longitudinal direction thereof.

8. The magnesium oil pan according to claim 1, wherein the main reinforcement rib has a lowest height of 2 mm to 5 mm.

9. An engine of a passenger vehicle comprising the magnesium oil pan according to claim 1.

10. A magnesium oil pan, which is mounted on a lower portion of a cylinder block of an engine, comprising:

a flange formed on a lateral surface in a middle portion of the oil pan so as to be coupled with the cylinder block;

a lower oil pan coupler formed in a lower portion of the oil pan so as to protrude downward from a bottom surface of the oil pan; and a bracket formed in an upper portion of the oil pan so as to be coupled with a chain cover of the engine, wherein the lower oil pan coupler has first reinforcement member on an outer lower wall of the oil pan, the first reinforcement member extending to a lower surface of the oil pan.

11. The magnesium oil pan according to claim 10, wherein the first reinforcement member has a width of 1.5 mm to 3 mm.

12. The magnesium oil pan according to claim 10, wherein the oil pan comprises four or more first reinforcement members.

13. A magnesium oil pan, which is mounted on a lower portion of a cylinder block of an engine, comprising:

a flange formed on a lateral surface in a middle portion of the oil pan so as to be coupled with the cylinder block;

a lower oil pan coupler formed in a lower portion of the oil pan so as to protrude downwards from a bottom surface of the oil pan; and a bracket formed in an upper portion of the oil pan so as to be coupled with a chain cover of the engine, wherein the lower oil pan coupler has an auxiliary reinforcement rib on an bottom surface of the oil pan which protrudes downwards, and wherein the auxiliary reinforcement rib has second reinforcement member on one lateral surface of the auxiliary reinforcement rib, the second reinforcement member extending to the bottom surface of the oil pan.

14. The magnesium oil pan according to claim 13, wherein the second reinforcement member has a width of 1.5 mm to 3 mm.

15. The magnesium oil pan according to claim 13, wherein the auxiliary reinforcement rib continuously runs from an inner wall of the lower oil pan coupler toward the other opposite inner wall and protrudes downwards from the bottom surface of the oil pan.

16. A magnesium oil pan, which is mounted on a lower portion of a cylinder block of an engine, comprising:

a flange formed on a lateral surface in a middle portion of the oil pan so as to be coupled with the cylinder block;

a lower oil pan coupler formed in a lower portion of the oil pan so as to protrude downwards from a bottom surface of the oil pan; and a bracket formed in an upper portion of the oil pan so as to be coupled with a chain cover of the engine, wherein the bracket has reinforcement post extending to the bottom surface of the oil pan.

17. The magnesium oil pan according to claim 16, wherein the reinforcement post extends to the bottom surface in the oil pan in a longitudinal direction thereof.

18. The magnesium oil pan according to claim 16, the oil pan comprises four or more reinforcement posts.

19. A magnesium oil pan, which is mounted on a lower portion of a cylinder block of an engine, comprising:

a flange formed on a lateral surface in a middle portion of the oil pan so as to be coupled with the cylinder block;

a lower oil pan coupler formed in a lower portion of the oil pan so as to protrude downwards from a bottom surface of the oil pan;

a bracket formed in a upper portion of the oil pan so as to be coupled with a chain cover of the engine; and a flat portion formed on the flange between the lower oil pan coupler and the bracket.

20. The magnesium oil pan according to claim 19, wherein the flat portion has a thickness of 3.5 mm or more.

* * * * *